United States Patent [19]

Murphy

[11] 4,415,443

[45] Nov. 15, 1983

[54] DISTILLATION PROCESS

[75] Inventor: Martin A. Murphy, Bernardsville, N.J.

[73] Assignee: Exxon Research and Engineering Co., Florham Park, N.J.

[21] Appl. No.: 282,046

[22] Filed: Jul. 10, 1981

[51] Int. Cl.[3] ..... C10G 7/00; B01D 3/38

[52] U.S. Cl. ..... 208/355; 208/354; 208/356; 203/73; 203/78

[58] Field of Search ..... 208/354, 355, 356; 203/73, 76, 78, 75, 82, 84

[56] References Cited

U.S. PATENT DOCUMENTS

| | | | |
|---|---|---|---|
| 2,149,058 | 11/1935 | Kraft | 208/355 |
| 2,322,652 | 6/1943 | McClintock . | |
| 2,461,694 | 2/1949 | McCubbin et al. | 203/78 |
| 2,736,688 | 2/1953 | Kraft | 208/355 |
| 2,901,407 | 7/1957 | Colton | 203/78 |
| 3,585,124 | 10/1968 | Myers | 208/354 |
| 4,274,944 | 6/1981 | Bannon . | |

*Primary Examiner*—Delbert E. Gantz
*Assistant Examiner*—Glenn A. Caldarola
*Attorney, Agent, or Firm*—Edward H. Mazer

[57] ABSTRACT

A method for improving the separation of a feed into a distillate and a bottoms product is disclosed. The subject invention includes a first distillation zone and a second distillation zone, each having rectification and stripping zones. Bottoms from the first stripping zone are passed into the second distillation zone. Distillate from the second rectification zone is removed utilizing a fluid evacuation means and returned to the first stripping zone.

9 Claims, 1 Drawing Figure

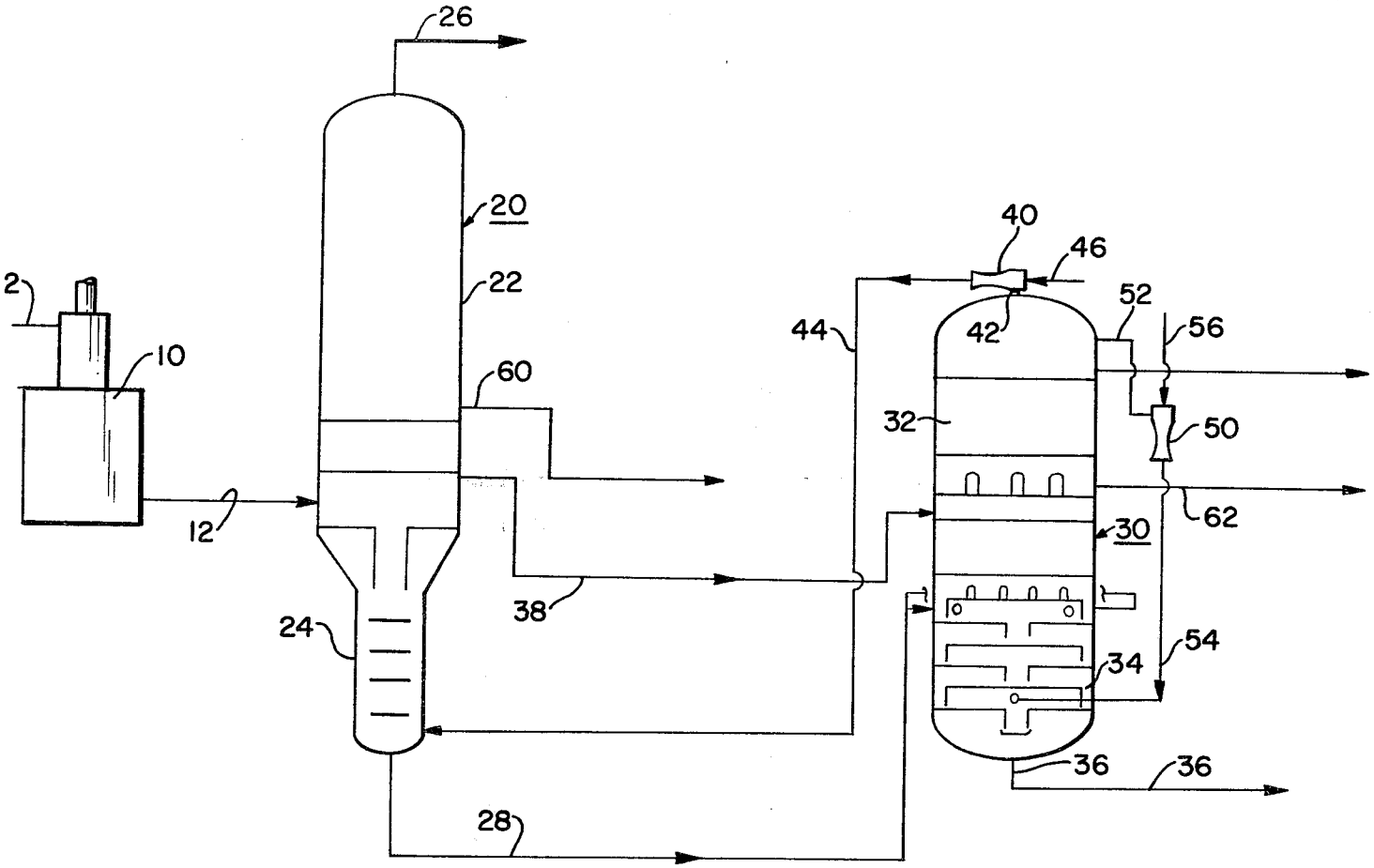
2
10
12
24
26
20
22
60
38
28
40
42
46
44
32
52
56
50
62
30
54
34
36
36

DISTILLATION PROCESS

BACKGROUND OF THE INVENTION

This invention is related to an improved method for the separation of a feed stream into a relatively low boiling distillate and a relatively high boiling bottoms stream. More specifically, this invention is directed at an improved, energy efficient method for separating a petroleum fraction into a distillate having a relatively low boiling point and a bottoms having a relatively high boiling point.

In the distillation of a liquid to separate the liquid into a distillate and a bottoms, steam frequently is added to impart heat and to aid in the separation. In the petroleum industry, steam frequently is added to the distillation column during the separation of feeds, such as vacuum residuum to improve the separation of the lighter components from the heavier components.

Often, after distillation equipment has been designed and installed, the desired distillation product requirements change and/or the feed composition changes. For example, in the petroleum industry the feeds entering the distillation zone frequently have a higher boiling point than was contemplated when the equipment was designed. Often it also is desired to strip out high boiling fractions from the bottoms product. In many instances, changes in the tower operating conditions may produce the desired products. In some cases, however, changes in the column operating conditions will not produce the desired distillate and bottoms at the desired operating rates, or the changes required would make operation of the column uneconomical. In other instances, utility limitations, i.e. cooling water and/or steam supply limitations may preclude significant changes in the distillation column operating conditions. Accordingly, in many instances the present distillation columns must be completely replaced or extensively modified, such as by replacing the column internals or by adding additional sections onto the column. Replacement or extensive modification of a distillation zone may be extremely costly. In addition to the actual cost for the replacement and/or modification of the column, this work will require the shutdown of the distillation zone for an extended period of time. In addition, distillation column modification and/or replacement frequently will necessitate replacement of substantial amounts of piping, instrumentation and related equipment.

U.S. Pat. No. 2,461,694 is directed at a process for the continuous distillation of fatty material from oils. This patent describes a process requiring two extraction zones. Feed enters near the top of the first zone and is flashed into a vapor, which is easily removed, and into a liquid which is steam stripped as it passes through the extraction zone. The bottoms from the first extractor are then passed to a second extractor where it is again steam stripped. Vacuum is applied to the second extractor by a steam jet. Vapor from the second column and the uncondensed steam from the steam jet are directed into the base of the first extractor. Since this process does not provide both rectification and stripping zones in each unit, and since this process does not reflux any overheads, product separation is undesirably low.

U.S. Pat. Nos. 2,615,833 and 3,421,567 disclose the use of steam ejectors to remove a vapor side stream from one location in a column and discharge the steam and vapor into a second location in the column either above or below the first location. These methods would not be beneficial, however in applications where a discrete new product is required without increasing the existing utility usage (e.g. steam consumption).

U.S. Pat. No. 4,261,814 discloses the use of a steam jet ejector to recirculate a vapor stream from the top of a vacuum pipestill to the bottom to permit either a deeper cut in the vacuum residuum or the same yields but using less steam. This patent does not disclose a method for producing a deeper cut, where the required fractionation products could not be obtained using only an existing column.

Accordingly, it is desirable to provide a process which will permit a significant improvement in distillation zone performance without requiring extensive modification of an existing column or replacement with a new distillation column.

It is also desirable to provide improved distillation zone performance without shutting down the existing distillation zone for an extended period of time.

It is further desirable to provide a process which will result in improved distillation zone performance with little or no increase in utility consumption.

The subject invention is directed at improved distillation zone performance in which a second distillation column communicates with the first distillation column. Bottoms from the first column are directed into the second column maintained under reduced pressure by an ejector means, such as a steam jet ejector. The overheads from the second column and the motive fluid from the ejector means are passed into the rectification zone of the first column.

SUMMARY OF THE INVENTION

The subject invention is directed at a method for separating a feed into a distillate relatively rich in lower boiling components and a bottoms relatively rich in higher boiling components comprising:

(a) passing the feed into a first distillation zone having a first stripping zone and a first rectification zone, wherein the feed is separated into a first distillate removed from the first rectification zone and a first bottoms removed from the first stripping zone; and (b) passing the first bottoms into a second distillation zone having a second rectification zone and a second stripping zone wherein the second distillation zone operates at a lower absolute pressure than the first distillation zone and wherein the bottoms from the first stripping zone are separated into a second distillate and a second bottoms, the rectification zone of the second column communicating with a fluid ejection means whereby second distillate from the second rectification zone is transferred by the fluid ejection means into the first stripping zone without intermediate condensation.

In a preferred embodiment, the fluid ejection means comprises a steam ejector. Steam utilized to evacuate the second distillation zone is directed with second distillate into the first stripping zone. The subject invention is particularly useful in the refining of heavy petroleum feeds, especially distillation column bottoms.

DESCRIPTION OF THE DRAWING

The FIGURE shows a simplified flow drawing of one method for practicing the subject invention.

DETAILED DESCRIPTION OF THE INVENTION

Referring to the FIGURE, one method for practicing the subject invention is shown. In this FIGURE, valves, pumps, instrumentation, piping and other items not necessary for an understanding of the subject invention have been omitted for clarity. Feed, such as atmospheric residuum, is passed from line 2 through a preheating means, such as furnace 10 where the feed temperature is increased. The feed exits preheater 10 through line 12 and enters a first fractionation or distillation zone, such as first distillation column 20, having a rectification zone 22 and a stripping zone 24. The feed is separated in column 20 into an overheads or distillate relatively rich in lower boiling compounds exiting rectification zone 22 through line 26 and a bottoms relatively rich in higher boiling compounds exiting from stripping zone 24 of column 20 through line 28 for transfer to a second distillation or fractionation zone, such as distillation column 30. Column 30, having a rectification zone 32 and a stripping zone 34 operates at a lower absolute top pressure than column 20. Column 30 is equipped with a fluid ejection means, such as steam jet ejector 40 having a steam source entering through line 46, to maintain the absolute pressure lower in column 30 than in column 20 at comparable locations in the columns. The feed entering column 30 is separated into a distillate, or overheads, and a bottoms. The overheads pass from rectification zone 32 through line 42, steam jet 40 and line 44 for return to stripping zone 24 without intermediate condensation. The bottoms from stripping zone 34 exit through line 36 for product recovery and/or further processing. Column 30 optionally may be provided with means to recycle material from rectification zone 32 to stripping zone 34. In the embodiment shown, fluid passes from rectification zone 32 through line 52 and through a fluid ejection means, such as steam ejector 50 having a steam source entering through line 56, for return to stripping zone 34 through line 54.

In the embodiment shown, one or more intermediate product streams also may be removed from columns 20, and 30 as, for example, product removed through lines 60, 62, and 64. Sidestreams of product also may be taken from one column and transferred to the other column as, for example, the overflash from column 20 which passes from zone 22 to zone 32 through line 38. While the subject invention has been shown with two columns, it is clear that additional columns also could be employed in the practice of the subject invention. The subject invention also is not dependent upon the use of any particular types of distillation or fractionation zones. Fluid ejector means of the type utilized in the practice of this invention are well known in the art. The ejector means comprises a relatively simple vacuum pump which has no moving parts. The ejector means includes a nozzle which discharges a high velocity jet of fluid, such as steam, across a suction chamber connected with the second rectification zone. This creates a vacuum in the suction chamber so that gas in the second rectification zone is drawn into the suction chamber and entrained by the motive fluid, such as steam, which then transports the vapor into the first stripping zone. While the evacuation means may be operable with many types of fluids, evacuation means typically are operated using steam as the motive fluid because of its relatively low cost. Accordingly, the subject invention is of particular utility in applications where steam stripping may also be useful, such as in the refining of petroleum. The utility of the present invention may be illustrated by the following example in which the present invention permits a significant separations improvement without a significant increase in energy consumption. A single vacuum pipestill 20 having a rectification zone 22, 33 feet in diameter and 60 feet in height and a stripping zone 24, 15 feet in diameter and 15 feet in height was operated on an atmospheric residuum feed entering at a temperature of approximately 400° C. With an absolute pressure at the top of approximately 55 mmHg, the still produced a bottoms product having a cut point (i.e., the equivalent atmospheric boiling point) of about 530° C. In order to strip out and recover additional compounds otherwise lost in the bottoms using prior art methods may have required replacement of the pipestill, extending the column and/or replacement of the column internals. Utilizing the present invention, it has been determined that the addition of a second column 30, 20 feet in diameter and 45 feet in height with two packed sections and five trays interconnected as shown will permit the cut point of the bottoms stream 36 to be increased from approximately 530° C. to approximately 565° C. In the one column operation, approximately 15,000 pounds per hour of steam were added to the stripping zone to assist in the removal of the more volatile components of the feed. Utilizing the subject two column design will eliminate the need for direct steam addition to stripping zone 24. Steam, however, will enter zone 24 through line 38 from ejector 40. The present invention permits products of varying compositions to be withdrawn as liquid or vapor from either distillation zone. The present design also permits intermediate streams such as overflash stream 38 to be transferred from one distillation zone to the other. Transfer of such intermediate streams may further improve the energy efficiency and overall product quality. A summary of key operating parameters for the separation of atmospheric residuum utilizing one distillation zone and utilizing two distillation zones is shown in Table I. From this table it can be seen that the present invention permits an increase in the bottoms product temperature, without increasing the steam consumption.

Although the subject invention has been described with reference to a specific embodiment, it is understood that it is capable of further modification. Any variations, uses or adaptations of the invention following, in general, the principles of the invention, are intended to be covered, including such departures from the present disclosure as come within known or customary practice in the art to which the invention pertains and as may be applied to the essential features hereinbefore set forth, and as fall within the scope of the invention.

TABLE I

| Parameter | Single Distillation Zone Design | Two Distillation Zone Design |
|---|---|---|
| Atmospheric residuum Feed rate (#/hr) | 900,000 | 900,000 |
| Total Distillate Production (#/hr) | 15,000 | 15,000 |
| Total Side Stream Production (#/hr) | 442,000 | 525,000 |
| Total Bottoms Production (#/hr) | 439,000 | 356,000 |
| Bottoms Cut Point (°C.) | 530 | 565 |

TABLE I-continued

| Parameter | Single Distillation Zone Design | Two Distillation Zone Design |
|---|---|---|
| Steam consumption (#/hr) | 34,000 | 34,000 |

What is claimed is:

1. A method for separating a feed into a distillate relatively rich in lower boiling components and a bottoms relatively rich in higher boiling components comprising:

(a) passing the feed into a first distillation zone having a first stripping zone and a first rectification zone, wherein the feed is separated into a first distillate removed from the rectification zone and a first bottoms removed from the stripping zone; and (b) passing the first bottoms into a second distillation zone having a second rectification zone and a second stripping zone wherein the second distillation zone operates at a lower absolute pressure than the first distillation zone and wherein the bottoms from the first stripping zone are separated into a second distillate and a second bottoms, the rectification zone of the second column communicating with a fluid ejection means, whereby second distillate from the second rectification zone is transferred by the fluid ejection means into the first stripping zone without condensation.

2. The method of claim 1 wherein the fluid ejection means is a steam jet ejector whereby steam passing through the ejector entrains second distillate and conveys the second distillate to the first stripping zone.

3. The method of claim 2 wherein the second distillation zone operates under vacuum.

4. The method of claim 3 wherein the first distillation zone is operated under vacuum.

5. The method of claim 4 further comprising an intermediate feed stream communicating between the first and second distillation zones whereby fluid from an intermediate point in the first distillation zone passes into an intermediate feed point in the second distillation zone.

6. The method of claim 5 wherein a product side stream is removed from the first rectification zone.

7. The method of claim 5 wherein a product side stream is removed from the second rectification zone.

8. In a distillation process wherein the feed stream is passed into a first distillation zone having a first rectification zone and a first stripping zone wherein the feed is separated into a first distillate relatively rich in lower boiling compounds exiting from the first rectification zone and a first bottoms relatively rich in higher boiling compounds exiting from the first stripping zone, the improvement which comprises:

(a) passing the first bottoms into a second distillation zone at a lower absolute pressure than the first distillation zone, the second distillation zone having a second rectification zone and second stripping zone wherein the first bottoms are separated into a second distillate exiting from the second rectification zone and a second bottoms exiting from the second stripping zone; and (b) passing the second distillate through a steam jet ejector communicating with the second rectification zone and returning the second distillate without condensation to the first stripping zone.

9. The method of claim 8 wherein the feed is residuum from an atmospheric distillation.

* * * * *